US008476845B2

(12) United States Patent
Riesebosch

(10) Patent No.: US 8,476,845 B2
(45) Date of Patent: Jul. 2, 2013

(54) BRIGHTNESS CONTROL FOR LIGHTING FIXTURES

(75) Inventor: Scott Riesebosch, St. Catharines (CA)

(73) Assignee: CRS Electronics, Ontario (CA)

( * ) Notice: Subject to any disclaimer, the term of this patent is extended or adjusted under 35 U.S.C. 154(b) by 247 days.

(21) Appl. No.: 13/017,710

(22) Filed: Jan. 31, 2011

(65) Prior Publication Data

US 2012/0194098 A1 Aug. 2, 2012

(51) Int. Cl.
*H05B 37/02* (2006.01)

(52) U.S. Cl.
USPC ..... 315/308; 315/255; 315/277

(58) Field of Classification Search
USPC ..... 315/250, 254, 255, 276, 277, 291, 315/307, 308
See application file for complete search history.

(56) References Cited

U.S. PATENT DOCUMENTS

| | | | | |
|---|---|---|---|---|
| 8,084,948 | B2 * | 12/2011 | Van Der Veen et al. | 315/151 |
| 8,115,419 | B2 * | 2/2012 | Given et al. | 315/307 |
| 2010/0301751 | A1 * | 12/2010 | Chobot et al. | 315/86 |
| 2010/0308749 | A1 * | 12/2010 | Liu | 315/307 |

* cited by examiner

*Primary Examiner* — Thuy Vinh Tran
(74) *Attorney, Agent, or Firm* — Bingham McCutchen LLP

(57) ABSTRACT

A brightness controller determines a lowest dimmer setpoint and an average power to a light source at the lowest dimmer setpoint. An average power supplied to the light source is set based on a setting of the dimmer relative to the average power at the lowest dimmer setpoint.

13 Claims, 5 Drawing Sheets

BRIGHTNESS CONTROL FOR LIGHTING FIXTURES

TECHNICAL FIELD

In various embodiments, the invention relates to brightness controllers for light-emitting diode (LED) and other types of lights.

BACKGROUND

In an effort to reduce power consumption and to conserve energy, many households and commercial establishments in the United States and around the world are replacing conventional, energy-demanding light sources such as incandescent and halogen lights with more efficient LED sources (e.g., LED lamps, modules, etc.). As with conventional lights, dimmers are commonly used with the LED-based fixtures, allowing a user to choose a desired level of brightness. In some configurations, a single dimmer may be used to adjust the brightness of more than one LED source, and the user may expect the brightness of the different LED sources to be substantially similar, according to the setting of the dimmer.

A dimmer generally dims a light source (i.e., controls its brightness) by controlling the average power supplied to the light source. To achieve this, a phase dimmer receives the alternating current (A/C) mains power signal (e.g., 110 VAC, 230 VAC, etc.) and chops it, i.e., sets the signal value at or near zero for a certain duration, also called a phase. The larger the phase of the A/C mains signal chopped, the less power will be supplied by the dimmer's output signal. Therefore, the brightness of the light source, which is proportional to the average power received, is inversely proportional to the phase of the dimmer's output that is chopped.

The A/C mains power signal, whether chopped by a dimmer or unchopped, is often unsuitable for use by a LED and/or conventional light source (e.g., halogen lamp). Therefore, a transformer is used to condition the A/C mains or dimmer output signal into a suitable power signal. Typically, a transformer receives an input signal having a certain root-mean-squared (RMS) voltage (e.g., 110 VAC, 230 VAC, etc.) and generates an output signal having a similar "envelope" but a different (usually lesser) RMS voltage (e.g., 12 VAC, 24 VAC, etc.).

The envelope of a signal waveform is the shape obtained by connecting the signal peaks and ignoring the instantaneous signal values between successive peaks. A transformer output signal having a similar envelope as that of the input signal generally implies that when the input signal is at or near zero the envelope of output signal is also at or near zero. When the input signal is at or near its peak, the envelope of the output signal is also at or near its peak (although the two peak values may be different), and when the input signal is chopped, so is the output signal. As a result, the average power supplied by the transformer to the light source is adjusted according to the dimmer setting.

Some transformers do not generate an output signal having a similar envelope because they do not "trigger," i.e., initiate power conditioning, immediately after the signal crosses the zero level. Instead, these transformers trigger after a short delay, usually on the order of a few hundred microseconds. As a result, the transformer output remains substantially zero during a certain phase in addition to the phase during which the output is chopped in response to the dimmer setting. Thus, the average power delivered by a transformer is determined not only by the dimmer setting but also by the instant at which the transformer triggers. As a result, the brightness of the light source powered by the transformer is slightly less than that required by the dimmer setting due to the additional chopping caused by the delayed triggering of the transformer.

Furthermore, different transformers may trigger at different instants, and hence, the time period other than the chopping phase during which the transformer output remains substantially zero can be different for different transformers. As a consequence, the average power supplied by each transformer in response to a certain dimmer setting can be different. This may cause the brightness of various LED sources to be substantially different for the same dimmer setting, which may be inconsistent with the user's expectation. Accordingly, there is a need for a brightness controller that adjusts the brightness of one or more LED and/or other lights with substantial uniformity for a given dimmer setting.

SUMMARY OF THE INVENTION

In various embodiments, the present invention features a brightness controller that determines a minimum dimmer setting and adjusts the brightness of one or more LED sources receiving power from the dimmer based on the user-set position of the dimmer relative to the determined minimum setting. For a group of LED lights receiving power from one dimmer, the average power supplied to each LED light (and, hence, its brightness) is adjusted based on this determined minimum dimmer setting in a manner that accounts for differences among the transformers supplying power to the LED lights, so that the brightness of each LED light is substantially the same. In various embodiments, the minimum dimmer setting is determined for each transformer and/or LED source by "learning" the lowest setpoint of the dimmer, which is accomplished by monitoring the transformer's output waveform and identifying the minimum duty cycle of its envelope. The duty cycle is the ratio of the time period during which the envelope signal is substantially non-zero and the total cycle time.

When the minimum duty cycle is identified, the corresponding setting of the dimmer is deemed to be the lowest setpoint, and the average power level supplied to the LED light is adjusted based on this minimum level. Suppose, for example, that a dimmer may be set (e.g., using a rotatable knob) to a desired percentage of full power. In accordance herewith, that percentage uses the determined minimum setpoint as the "zero" level, so that the setting of the dimmer may correspond to a different percentage than one based on a minimum setpoint defined as zero average power.

This minimum setpoint can be applied across all transformers so that variations thereamong are eliminated in terms of output. That is, by determining for each transformer the duty cycle corresponding to the determined minimum and basing the duty cycle for a given level of dimming on the determined minimum for that transformer, the average power supplied to all of the LEDs will be consistent. In this way, the actual value of the duty cycle of different transformers can be different because, for example, their trigger times are different, but brightness will be constant across LEDs. In particular, as the dimmer is adjusted to increase the brightness, the duty cycle of each transformer increases and correspondingly, the power supplied to the LED is increased from the pre-determined minimum level at a uniform ramp-up rate, causing the brightness of the various LEDs to be substantially uniform.

Accordingly, in a first aspect, a method of adjusting brightness of a light source controlled by a dimmer includes determining a lowest dimmer setpoint and an average power to the light source at the lowest dimmer setpoint. An average power supplied to the light source is set based on a setting of the dimmer relative to the average power at the lowest dimmer setpoint.

One or more of the following embodiments may be included. Determining a lowest dimmer setpoint may include monitoring a power signal supplied to the light source, identifying (based on a characteristic of the power signal) a lowest dimmer setpoint, and setting the brightness of the light source to a pre-determined minimum level based at least in part on the lowest dimmer setpoint. A current dimmer setting may be identified based on a characteristic of the power signal, and the brightness of the light source may be adjusted according to a difference between the current dimmer setting and the lowest dimmer setpoint. Brightness of the light source may be adjusted at a pre-determined ramp-up rate.

The characteristic of the power signal may be the duty cycle of the signal, and identifying the current dimmer setting may include measuring a current duty cycle for a current cycle of the power signal. If a minimum duty cycle has not been set, the current duty cycle is set as the minimum duty cycle. If it has, the current duty cycle is compared with the minimum duty cycle and, if it is less, the minimum duty cycle is reset as the current duty cycle. The lowest dimmer setpoint is associated with the minimum duty cycle. If the current duty cycle is greater than the minimum duty cycle, a difference may be computed between the current duty cycle and the minimum duty cycle; the dimmer level may be determined according to the computed difference.

The light source may be a LED source (e.g., a LED lamp, a LED module, and/or a LED array), and the power signal may be provided by an electronic transformer that receives an input signal from a phase dimmer. The adjusting step may include regulating current or voltage supplied to the light source.

In general, in another aspect, a method of substantially uniformly adjusting brightness of a plurality of light sources controlled by a dimmer includes determining, at each light source, a lowest dimmer setpoint. A brightness of each light source is set to one pre-determined minimum level based on the lowest dimmer setpoint of the light source such that brightness of all light sources is substantially uniform.

One or more of the following features may be included. An average power and/or current delivered to each of the plurality of light sources may be substantially uniform among the light sources. A non-minimum dimmer setting may be determined at each light source, and a brightness of each light source may be adjusted according to a difference between the non-minimum dimmer setting and the lowest dimmer setpoint. Brightness of all light sources may be adjusted at a substantially uniform ramp-up rate.

In general, in yet another aspect, a brightness controller for adjusting a brightness of a light source controlled by a dimmer includes a dimmer-level estimator and a driver. The dimmer-level estimator determines a current and a lowest dimmer level. The driver adjusts the brightness of the light source according to the current dimmer level and average power supplied to the light source at the lowest dimmer level.

One or more of the following features may be included. The dimmer-level estimator may include a duty-cycle estimator, a storage device, a comparator, and a dimmer-level calculator. The duty-cycle estimator estimates a current duty cycle of a power signal supplied to the light source and the storage device stores a minimum duty cycle of the power signal estimated by the duty-cycle estimator and associates the minimum duty cycle with a lowest dimmer level. The comparator compares the current duty cycle with the stored minimum duty cycle and updates the stored minimum duty cycle if the current duty cycle is smaller than the stored minimum duty cycle, and the dimmer-level calculator determines a current dimmer level corresponding to a difference between the current duty cycle and the stored minimum duty cycle. The light source may be a LED source (e.g., a LED lamp, a LED module, and/or a LED array). The driver may be a constant current driver and/or a voltage regulator.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations. As used herein, the term "substantially" means±10%, and in some embodiments, ±5%.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1:
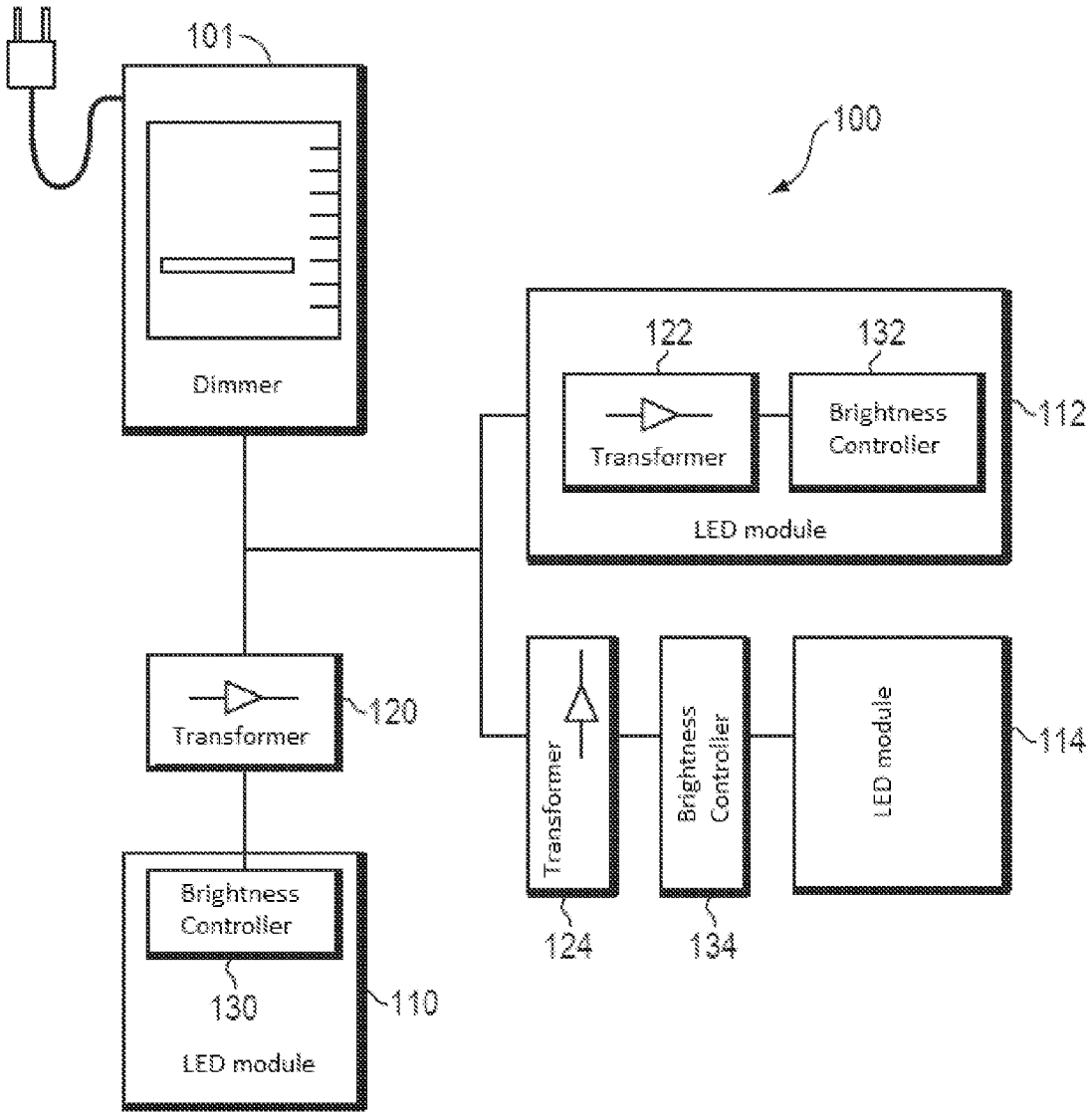
FIG. 1 schematically shows a system using brightness controllers.

The lighting system 100 shown in FIG. 1 includes a dimmer 101 and three LED modules 110, 112, 114. The dimmer 101 receives a signal from an A/C mains 102 and provides a chopped signal 104 according to the dimmer setting (e.g., the angular position of a dimmer knob between minimum and maximum settings) to the electronic transformers 120, 122, 124. Each of the three transformers supplies power to one of the LED modules 110, 112, 114. In the lighting system as shown, the transformer 122 is contained within the LED module 112, and the transformers 120, 124 are distinct components connected to the LED modules 110, 114, respectively. The current invention is not limited, however, to any particular type of LED modules or transformers, and any combination of LED modules having built-in or external transformers is within the scope of the current invention.

Each transformer 120, 122, 124 receives the dimmed (i.e., chopped) A/C mains waveform as shown below with reference to FIG. 2 and generates a corresponding waveform at a smaller voltage. The electronic transformer 120 is a 10:1 step-down transformer that converts a 120 VAC waveform into a 12 VAC waveform, and provides it to the brightness controller 130 and the LED module 110. The transformers 122, 124 are 5:1 step-down transformers, thereby providing a 24 VAC output waveform to the brightness controllers 132, 134, respectively, and also to the modules 112, 114, respectively. The current invention, however, is compatible with any combination of transformers having any input-to-output ratios. The brightness controllers 130, 132 are included in the LED modules 110, 112, respectively, but the controller 134 is a distinct component connected to the module 114. The illustrated configurations of a transformer, brightness controller, and LED module described above are exemplary only, and depict the arrangements that can be used; typically, in a given application, a single configuration is used throughout.

Figure 2:
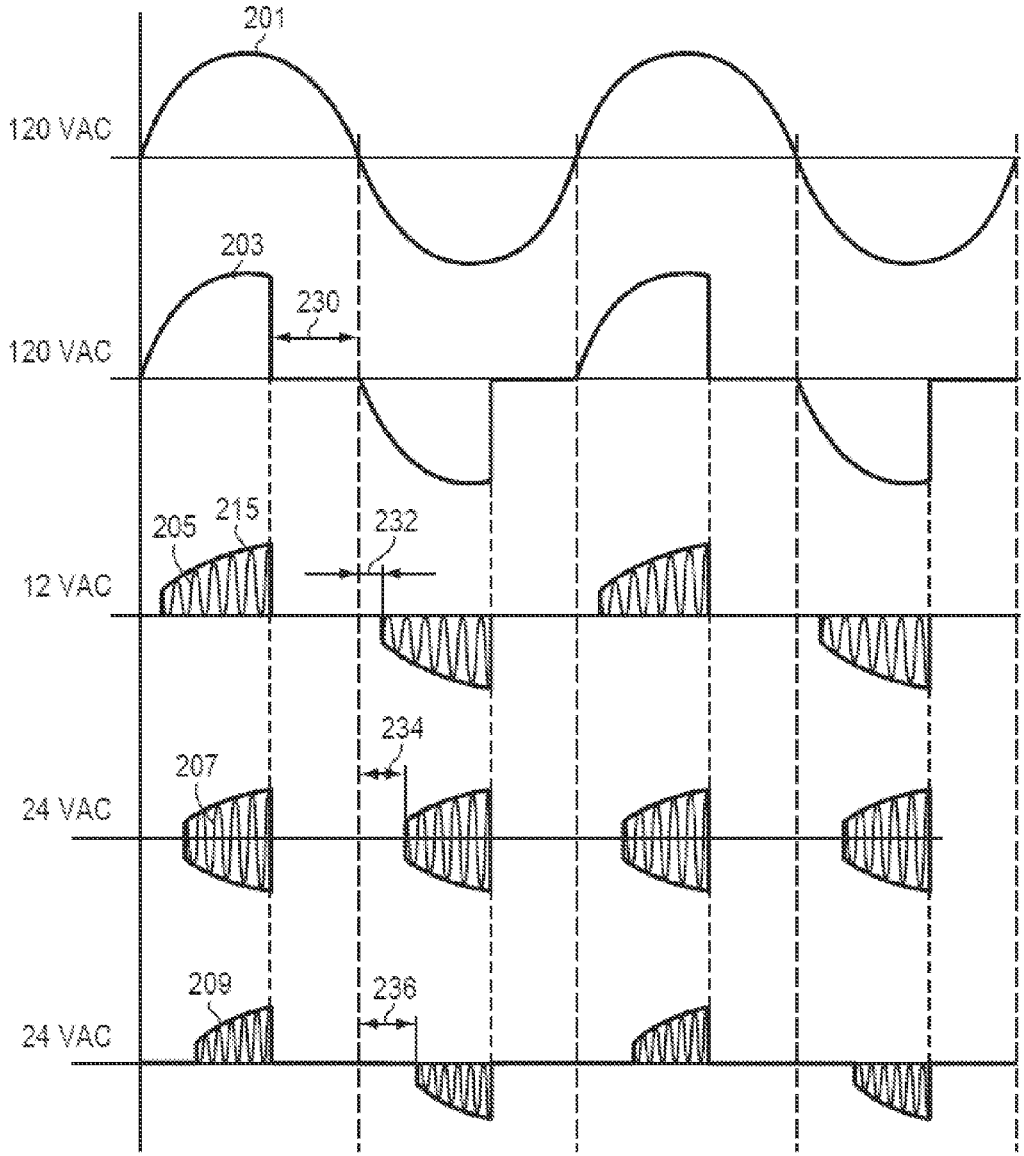
FIG. 2 depicts an A/C mains signal and output signals of a dimmer and various transformers in an exemplary system, corresponding to a certain dimmer setting.

The A/C mains signal 201 depicted in FIG. 2 has a RMS voltage of 120 V and frequency of 60 Hz, corresponding to a half-cycle time of approximately 8,333 microseconds. The dimmer 101 receives the signal 201 as input and produces a chopped output signal 203. The amplitude and frequency of the signal 203 are substantially the same as those of the signal 201, respectively. However, during a time period (i.e., phase) denoted as 230 (approximately 2,000 microseconds) the voltage of signal 203 is nearly zero. As the dimmer 101 is adjusted the duration of the phase 230 increases or decreases.

The dimmer 101 varies the duration of the chopped portion of the signal from zero microseconds, corresponding to the original unchopped waveform that provides maximum average power to the light (resulting in maximum brightness) to 7,000 microseconds, corresponding to lowest dimmer setting, which in turn provides minimum average power to the light and produces the minimum brightness level. It should be understood, however, that the range described above is illustrative only and that other ranges, including longer and/or shorter phases of chopping, are within scope of the present invention. Moreover, the dimmer 101 employs trailing-edge chopping in which the phase 230 appears immediately before the unchopped signal would cross the zero level. Trailing-edge phase dimmers are commonly used with electronic transformers, but a leading-edge dimmer that chops the waveform immediately after zero crossing is also within the scope of the invention.

The transformer 120 receives the signal 203 and produces an output signal 205, typically oscillating at a frequency 10 or 100 times the frequency of the A/C mains signal 201. The envelope 215 of the signal 205 has an amplitude of 12 V and a frequency of 60 Hz. As the signal 205 is derived from the signal 203, the transformer output signal 205 and its envelope 215 are also chopped during the phase 230, which has a duration of approximately 2,000 microseconds. Moreover, the transformer 120 does not trigger for a duration of 232 (approximately 100 microseconds) after the zero crossing of signal 203. Therefore, immediately after zero crossing, the output signal 205 remains at or near zero for approximately 100 microseconds. Thus, the output signal 205 is "on" for approximately 6,233 microseconds during one half cycle.

The transformers 122, 124 also receive the signal 203 and produce output signals 207, 209, respectively. The transformer 122 does not trigger for approximately 200 microseconds after the zero crossing, and hence, the signal 207 remains at or near zero for the duration indicated at 234 (approximately 200 microseconds), in addition to the duration 230. Similarly, the transformer 124 triggers after a delay indicated at 236 (approximately 300 microseconds) after the zero crossing, and accordingly, the signal 207 remains at or near zero for the duration 236, in addition to the duration 230. Thus, the signals 205, 207 are "on" for approximately 6,133 and 6,033 microseconds, respectively, during one half cycle.

The on duration of the signal 209 is less than that of the signal 205 by approximately 200 microseconds, and hence, the average power provided by the signal 209 is less than that supplied by the signal 205 (and signal 207). But, the brightness controllers 130, 132, 134 control the brightness of the corresponding LED sources not in response to the on duration or duty cycle of the corresponding transformer output signals, but according to the estimated dimmer setting, as described below.

Figure 3:
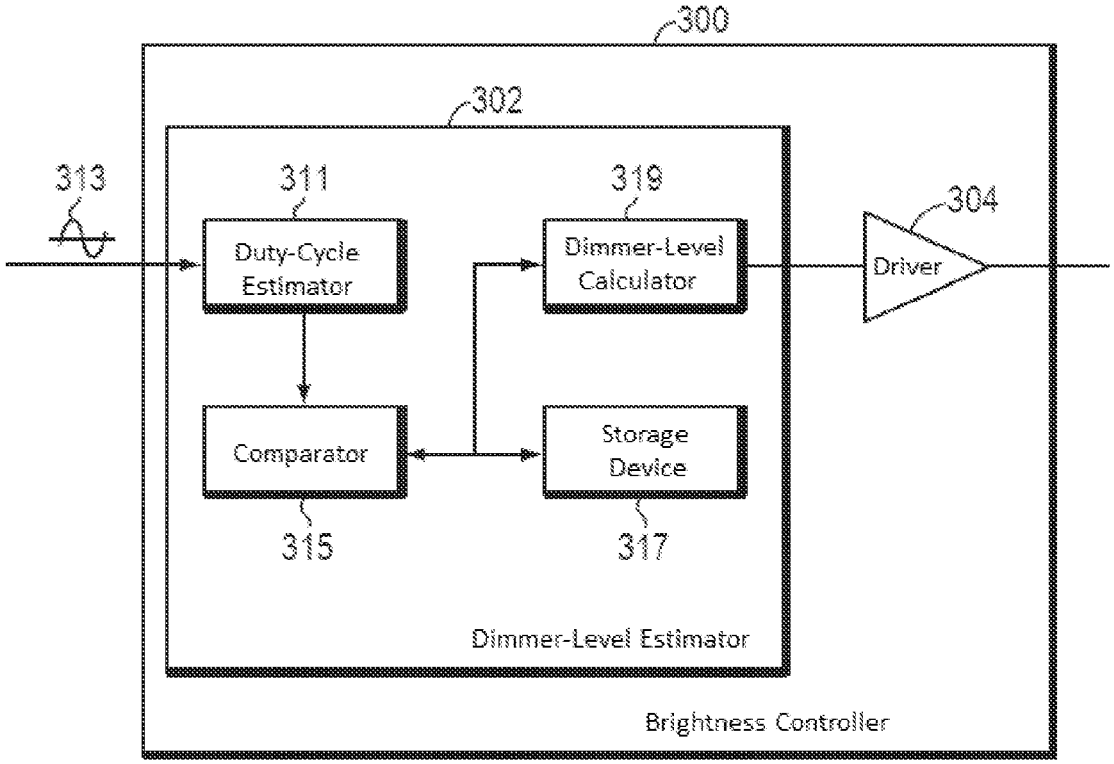
FIG. 3 schematically shows an exemplary brightness controller.

A brightness controller 300, shown in FIG. 3, is associated with each light source. The brightness controller 300 includes a dimmer-level estimator 302 that includes a duty-cycle estimator 311. The duty-cycle estimator 311 monitors the input signal 313 received from a transformer, filtering out high-frequency oscillations in the input signal 313 and measuring the "off" duration for which the input signal is at or near zero. The off duration includes both the phase of the input signal during which the dimmer chops the input signal provided to the transformer, and the phase during which the transformer has not triggered. The duty cycle is determined by dividing the measured off duration by the cycle time (or half-cycle time) corresponding to the known frequency of the A/C mains waveform (e.g., 60 Hz in North America, 50 Hz in Europe).

In the illustrated embodiment, the dimmer-level estimator 302 of the brightness controller 300 also includes a comparator 315 and a storage device 317. At system power up for the first time, it is assumed that the dimmer is set at the lowest level. Accordingly, the duty cycle measured for the first time is used as the minimum duty cycle estimate, which is stored in the storage device 317. In some instances, this assumption may not be correct, and a user may adjust the dimmer setting to a value lower than that set at the first system power up. Therefore, the comparator 315 compares the duty cycle estimate obtained from each subsequent measurement with the value stored in the storage device 317. If a lower estimate of the duty cycle is measured, that estimate is the minimum duty-cycle estimate that replaces the previously stored value in the storage device 317.

The comparator 315 can be custom logic circuitry and the storage device 317 can be a zero-power flash memory such that the value stored in the storage device 317 is retained even when the power to the LED source and/or the brightness controller 300 is turned off. In other embodiments, the comparator and the storage device can be constructed using a microcontroller.

Figure 4:
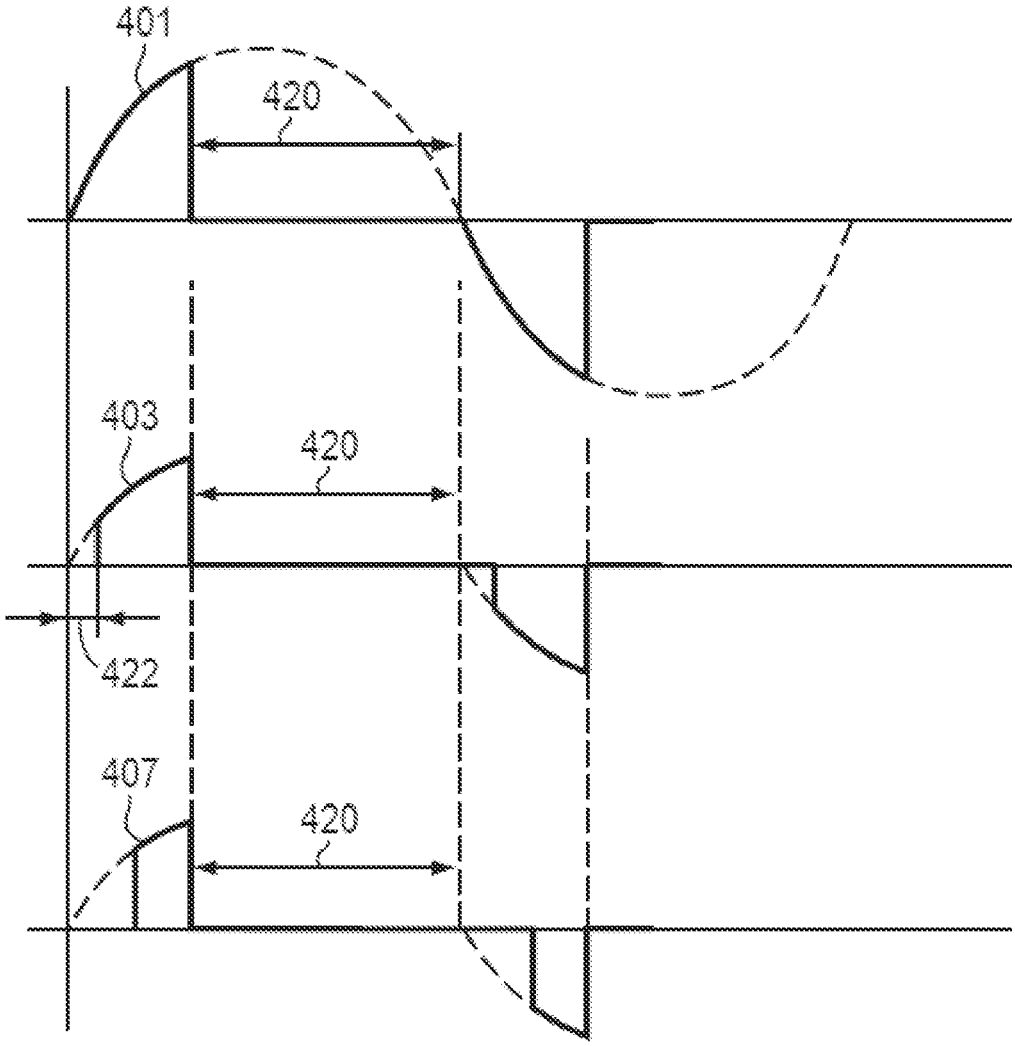
FIG. 4 depicts output signals of a dimmer and two transformers corresponding to a different dimmer setting.

When the estimated minimum duty cycle is stored in the storage device 317, the brightness controller adjusts the average power supplied to the associated LED source based on a user-set dimmer level relative to the stored value. As illustrated with reference to FIG. 4, the duration 420 during which the dimmer output 401 is chopped, corresponding to the lowest dimmer setpoint, is approximately 7,500 microseconds. The transformer 120 receives the signal 401 and outputs a signal 403 that remains at or near zero for a duration denoted as 422 of approximately 100 microseconds until the transformer 120 triggers and for the duration 420. Accordingly, the brightness controller 130 estimates the minimum duty cycle of the signal 403 to be approximately 9%.

The transformer 124 also receives the signal 401 and outputs a signal 407, which remains at or near zero for approximately 7,800 microseconds. Accordingly, the brightness controller 134 determines the minimum duty cycle of the signal 407 to be approximately 6%. The minimum duty cycles estimated by the brightness controllers 130, 134 are substantially different, but nevertheless, the LED modules 110, 114 receive the same average power.

When a user sets the dimmer 101 at a level other than the minimum level, the brightness of the three LED modules is increased in a uniform manner. Therefore, referring to FIG. 3, the duty-cycle estimator 311 computes a current duty cycle corresponding to the changed dimmer level. The comparator 315 determines that the current duty cycle is greater than the minimum duty cycle stored in the storage device 317. Then, a dimmer-level calculator 319 in the dimmer-level estimator 302 computes the difference between the current duty cycle and the minimum duty cycle. The difference may also be expressed as a percentage increase with reference to the minimum duty cycle. Using the calculated difference, the dimmer-level calculator 319 determines a dimmer level corresponding to the current duty cycle (e.g., dimmer level of 4, 6, 9, etc.).

A driver 304 contained in the brightness controller 300 uses the dimmer level determined by the dimmer-level calculator 319 and adjusts the brightness of the LED module at a pre-determined ramp-up rate. The driver 304 is a constant-current driver, but other types of drivers such as pulse-width modulators and voltage regulators for non-LED sources of light can also be used. In the system 100 of FIG. 1, the driver of each brightness controller uses the same ramp-up rate, and hence, the brightness of all three LED modules is increased (or decreased) substantially uniformly.

Figure 5:
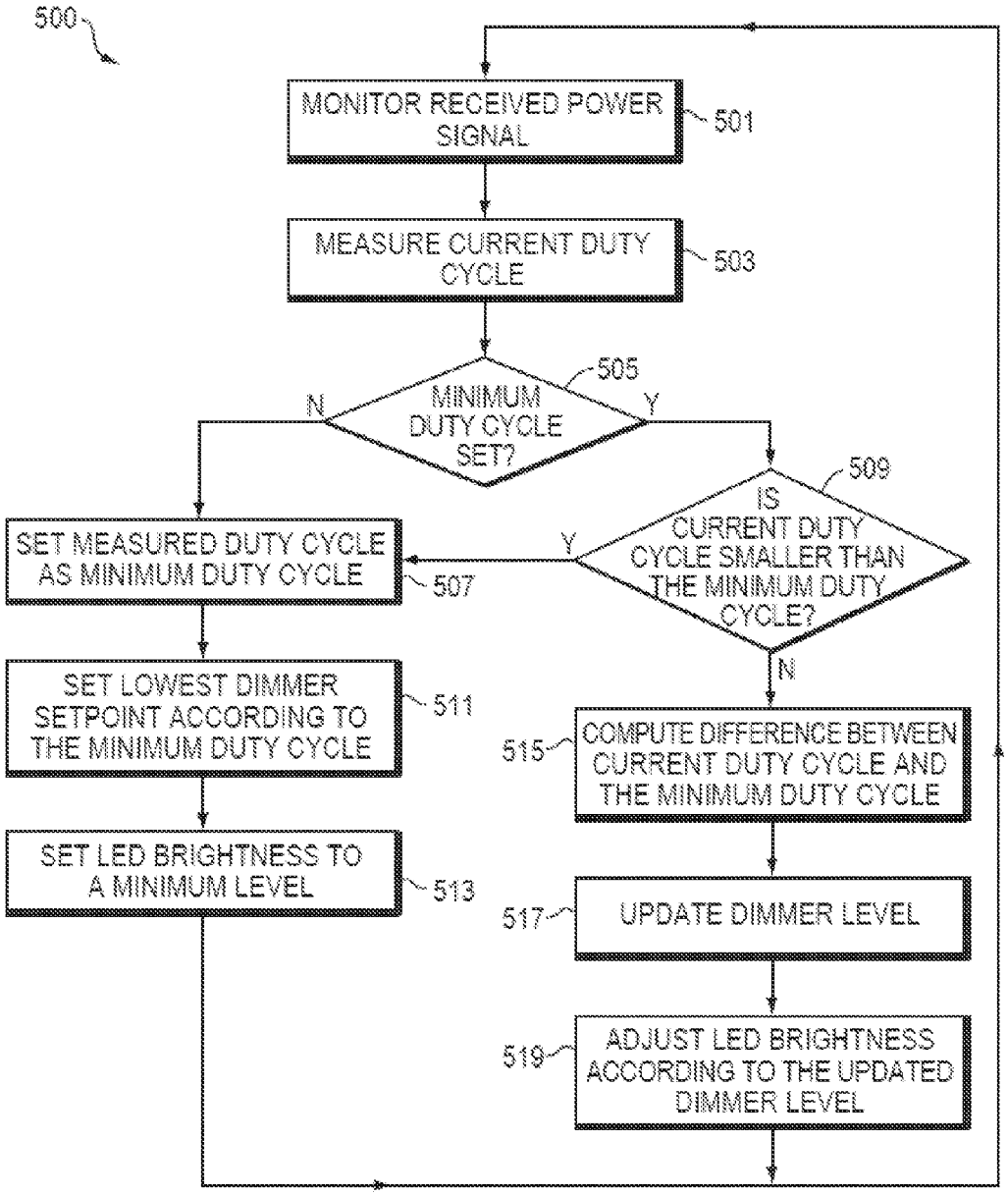
FIG. 5 shows a flow diagram of the steps of setting the brightness of a light source using a brightness controller.

In one embodiment, a lighting system and brightness controllers described above are operated according to a method 500 illustrated with reference to FIG. 5. The power signal supplied to a LED source is monitored in step 501. In step 503, a current duty cycle is measured by determining the on and/or off duration of the received power signal. When the system is powered up for the first time, there is no previously determined minimum duty cycle. If it is determined in step 505 that a minimum duty cycle has not been set, the duty cycle measured in step 503 is set as the minimum duty cycle in step 507. But at power up, the dimmer may not be set at the minimum level and the user would do so a later time. Therefore, in step 509, a current duty cycle measured at step 503 during a subsequent iteration would be compared to and found to be less than the minimum duty cycle set previously. Accordingly, the current duty cycle is set as the minimum duty cycle in step 507. Then, in step 511, a lowest dimmer setpoint is associated with the minimum duty cycle, and brightness of the LED source is set to a pre-determined minimum level such as 15% or 20% of maximum brightness in step 513.

During the course of operation, the user may increase the dimmer setting. Accordingly, in step 515, the difference between the current duty cycle and the minimum duty cycle is computed. Using the difference, which may be expressed as a percentage increase relative to the minimum duty cycle, an updated dimmer level is determined in step 517. As described above, different LED modules may receive power from different transformers having different trigger times. Therefore, the actual values of the current and minimum duty cycles measured by different brightness controllers may be different. Nevertheless, the percentage change in the current duty cycle relative to each minimum duty cycle would be substantially the same, and hence, the updated dimmer levels corresponding to the various light sources would generally be identical.

In step 519, the brightness of the LED source is adjusted according to the updated dimmer level and a pre-determined ramp-up rate. The ramp-up rate can be, for example, 4% per increment of the dimmer setting. Thus, if the minimum average power level is 20% and the dimmer level determined in step 517 is 5, the average power to all LED sources would be adjusted to 40% of the maximum. Accordingly, the brightness of all LED lights is adjusted substantially uniformly. It should be understood that the minimum average power level of 20% and the ramp-up rate of 4% are illustrative only, and that other higher or lower minimum levels (e.g., 10% or 50%) and other rates (e.g., 1%, 6%, etc.) are within the scope of the invention.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A method of adjusting brightness of a light source controlled by a dimmer, the method comprising the steps of:

determining a lowest dimmer setpoint and an average power to the light source at the lowest dimmer setpoint, wherein determining the lowest dimmer setpoint comprises:

(i) monitoring a power signal supplied to the light source;

(ii) identifying, based on a characteristic of the power signal, a lowest dimmer setpoint and a current dimmer setting;

(iii) setting the brightness of the light source to a pre-determined minimum level based at least in part on the lowest dimmer setpoint; and (iv) adjusting the brightness of the light source according to a difference between the current dimmer setting and the lowest dimmer setpoint; and setting an average power supplied to the light source based on a setting of the dimmer relative to the average power at the lowest dimmer setpoint.

2. The method of claim 1, wherein brightness of the light source is adjusted at a pre-determined ramp-up rate.

3. The method of claim 1, wherein the characteristic of the power signal is duty cycle of the signal, and the identifying step comprises:

measuring a current duty cycle for a current cycle of the power signal;

if a minimum duty cycle has not been set, setting the current duty cycle as the minimum duty cycle;

if a minimum duty cycle has been set: (i) comparing the current duty cycle with the minimum duty cycle, and (ii) if the current duty cycle is less than the minimum duty cycle, resetting the minimum duty cycle as the current duty cycle; and associating the lowest dimmer setpoint with the minimum duty cycle.

4. The method of claim 3, further comprising the steps of:

computing a difference between the current duty cycle and the minimum duty cycle, if the current duty cycle is greater than the minimum duty cycle; and determining the dimmer level according to the computed difference.

5. The method of claim 1, wherein the light source is a LED source.

6. The method of claim 5, wherein the LED source is at least one of a LED lamp, a LED module, or a LED array.

7. The method of claim 1, wherein the adjusting step comprises regulating current or voltage supplied to the light source.

8. The method of claim 1, wherein the power signal is provided by an electronic transformer receiving an input signal from a phase dimmer.

9. A brightness controller for adjusting a brightness of a light source controlled by a dimmer, the brightness controller comprising:

a dimmer-level estimator for determining a current and a lowest dimmer level, wherein the dimmer-level estimator comprises:

(i) a duty-cycle estimator for estimating a current duty cycle of a power signal supplied to the light source;

(ii) a storage device for storing a minimum duty cycle of the power signal estimated by the duty-cycle estimator, and associating the minimum duty cycle with a lowest dimmer level;

(iii) a comparator for comparing the current duty cycle with the stored minimum duty cycle, and updating the stored minimum duty cycle if the current duty cycle is smaller than the stored minimum duty cycle; and (iv) a dimmer-level calculator for determining a current dimmer level corresponding to a difference between the current duty cycle and the stored minimum duty cycle; and a driver for adjusting the brightness of the light source according to the current dimmer level and average power supplied to the light source at the lowest dimmer level.

10. The brightness controller of claim 9, wherein the light source is a LED source.

11. The brightness controller of claim 10, wherein the LED source is at least one of a LED lamp, a LED module, or a LED array.

12. The brightness controller of claim 9, wherein the driver is a constant current driver.

13. The brightness controller of claim 9, wherein the driver is a voltage regulator.

* * * * *